United States Patent [19]

McCauley et al.

[11] Patent Number: 4,993,084

[45] Date of Patent: Feb. 19, 1991

[54] CANISTER FOR DEODORANT/DISINFECTANT MATERIAL

[76] Inventors: Charles R. McCauley, P.O. Box 1932; Robert E. Nicholson, 2339 Highview La., both of, Spring Valley, Calif. 92077

[21] Appl. No.: 485,554

[22] Filed: Feb. 27, 1990

Related U.S. Application Data

[63] Continuation-in-part of Ser. No. 348,909, May 8, 1989, abandoned.

[51] Int. Cl.[5] ..... E03D 9/02

[52] U.S. Cl. ..... 4/224; 4/225

[58] Field of Search ..... 422/263, 264, 266, 268, 422/301; 4/222, 225, 227, 228, 232, 490

[56] References Cited

U.S. PATENT DOCUMENTS

| | | | |
|---|---|---|---|
| D. 101,396 | 9/1936 | Pipenhagen | 4/222 X |
| 1,216,051 | 2/1917 | Bayley | 422/264 X |
| 1,321,586 | 11/1919 | Bachman | 4/222 X |
| 1,623,132 | 4/1927 | Pennell et al. | 4/225 |
| 2,501,260 | 3/1950 | Brodin | 422/266 |
| 3,416,897 | 12/1968 | Long et al. | 422/266 X |
| 3,521,306 | 7/1970 | Jacobs | 4/228 |
| 3,677,408 | 7/1972 | Dinizo, Jr. | 422/266 X |
| 4,262,372 | 4/1981 | Ryder | 4/222 |
| 4,325,150 | 4/1982 | Buddy | 4/490 |
| 4,841,578 | 6/1989 | Mercer | 4/224 |

FOREIGN PATENT DOCUMENTS

| | | | |
|---|---|---|---|
| 692859 | 11/1930 | France | 4/227 |
| 7904220 | 12/1980 | Netherlands | 4/228 |

*Primary Examiner*—Henry J. Recla
*Assistant Examiner*—Robert M. Fetsuga
*Attorney, Agent, or Firm*—Charles C. Logan, II

[57] ABSTRACT

A canister for cakes of deodorant/disinfectant material that is used in combination with a trailer or recreational vehicle having a water tank, a pump, a toilet not having a water tank, and tubing connecting the respective components together in series. The canister is connected between the pump and the toilet. The canister has a vertically elongated cylindrical body having a removable top lid. An inlet port boss member extends outwardly from the cylindrical body adjacent its bottom end. An outlet port boss member extends outwardly from the cylindrical body adjacent its top end. In one embodiment, a disc-shaped platform is supported inside the cylindrical body a predetermined height above the bottom wall and it supports the cakes of solid chemical deodorant/disinfectant. In a second embodiment, a measuring bucket for cakes of deodorant/disinfectant is removably inserted into the interior of the cylindrical body.

5 Claims, 3 Drawing Sheets

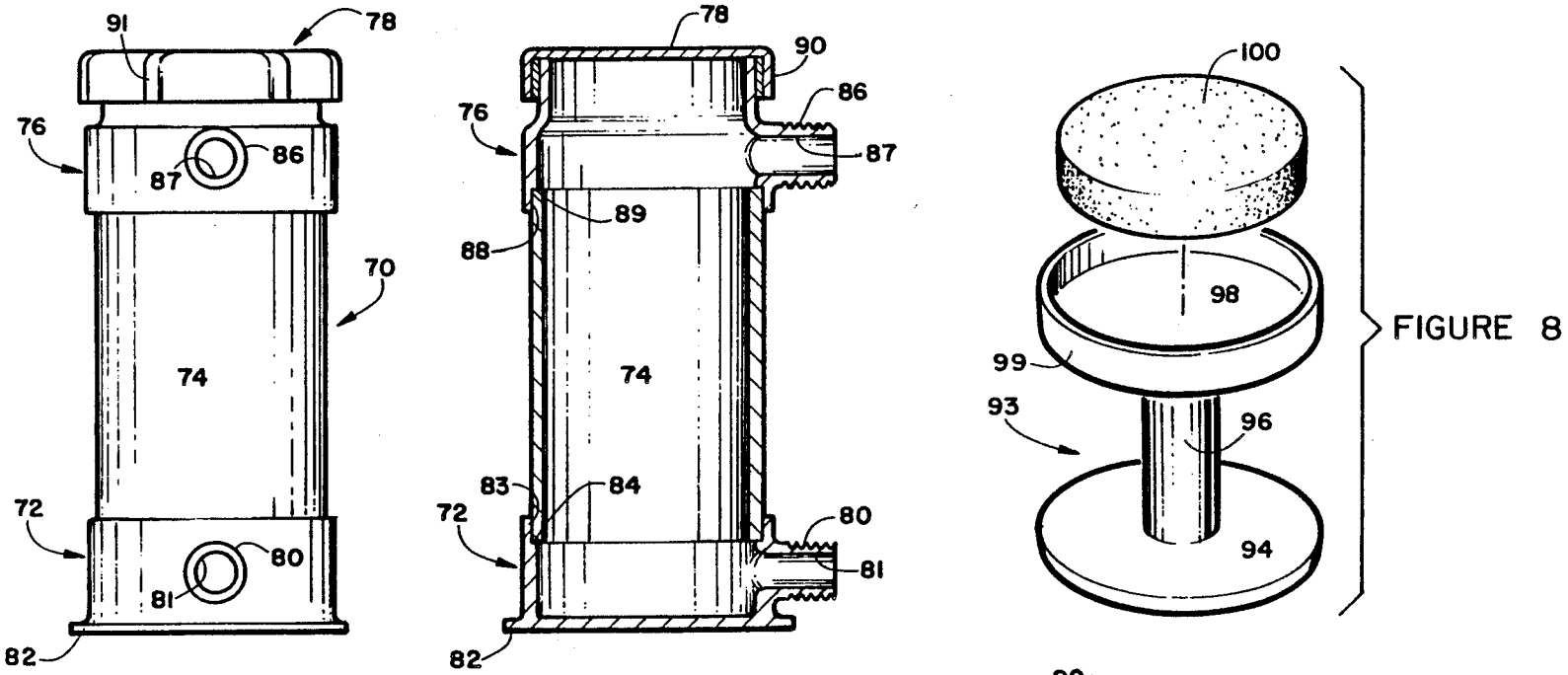
FIGURE 5
FIGURE 7
FIGURE 8
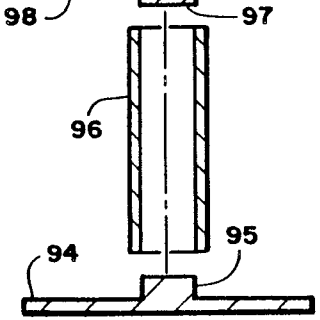
FIGURE 9
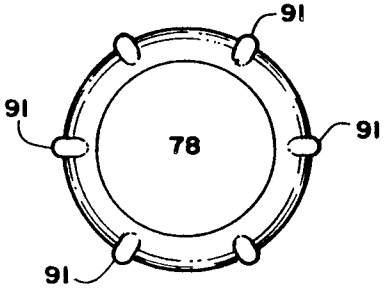
FIGURE 6

CANISTER FOR DEODORANT/DISINFECTANT MATERIAL

BACKGROUND OF THE INVENTION

This application is a continuation-in-part of U.S. patent application Ser. No. 348,909 filed 5/8/89, now abandoned.

The invention relates to a canister and more specifically to a container for cakes of deodorant/disinfectant material. The canister would be used in trailers and recreational vehicles having a water tank, a pump, a toilet not having a water tank, and tubing connecting the respective components together in series. The canister would be connected between the pump and the toilet.

Presently, it is common for housewives to place liquid or solid cakes of deodorant/disinfectant into the water tank portion of the toilet located in their homes. These chemicals aid in elimination of odors in the toilet bowl and also act to disinfect the toilet bowl area between flushes. When women are traveling or camping in trailers or recreational vehicles, they miss being able to deodorize and disinfect the toilet bowl area in the same easy manner as when they are home.

It is an object of the invention to provide a novel canister for cakes of deodorant/disinfectant material that can be installed in recreational vehicles and trailers having a water tank, a pump, a toilet not having a water tank, and tubing connecting the respective components together in series.

It is also an object of the invention to provide a novel canister for cakes of deodorant/disinfectant material that can be easily installed in a trailer or recreational vehicle by a do-it-yourselfer.

It is another object of the invention to provide a novel canister for cakes of deodorant/disinfectant material that is economical to manufacture and market.

SUMMARY OF THE INVENTION

Applicant's novel canister for cakes of deodorant-/disinfectant material has been designed to be utilized in trailers and recreational vehicles having a water tank, a pump, a toilet not having a water tank, and tubing connecting the respective components together in series. The canister would be connected in series between the pump and the toilet.

The canister has a vertically elongated cylindrical body having a removable screwtop lid. A tubular boss member extends outwardly from the cylindrical body of the canister adjacent its bottom end. It has an outlet port that is connected to a one way valve that prevents the deodorant/disinfectant material from traveling toward the water tank itself.

A tubular boss member extends outwardly from the cylindrical body adjacent its top end and it has an outlet port which receives the threaded neck of a coupling. The chamber within the canister has a vertically oriented rod member whose bottom end is secured to the inner surface of the bottom wall of the canister. A disc-shaped platform is secured to the rod member at a predetermined height above the bottom wall. One or more donut-shaped cakes of deodorant/disinfectant material may be positioned on the disc shaped platform.

In operation, a pump transmits water from the water tank to the inlet port of the canister. Since the tubular boss member forming the inlet port is tangentially oriented to the outer surface of the canister body, water entering the interior of the canister produces a swirling effect as it passes upwardly through the gap between the interior of the side walls and the disc-shaped platform thereby causing the cake of deodorant/disinfectant to dissolve in the water passing thereby. The tubular boss member extending outwardly from the top end of the cylindrical body also has a tangential orientation to receive the swirling water passing through the canister itself.

An alternative embodiment of the applicant's novel canister for cakes of deodorant/disinfectant material may be formed from three components that telescope together and have a lid. The cylindrical base member has an annular relief portion formed internally adjacent its top end to form a support shoulder therein. The cylindrical body member is telescopically received into the annular relief portion and supported by the shoulder. The top end of the cylindrical body member is telescopically received in the bottom end of a cylindrical upper body member that has an annular relief portion formed internally therein adjacent its bottom end to form a shoulder that mates with the top end of the cylindrical body member. A lid having a downwardly extending flange is threadably received on the top edge of the cylindrical upper body member. A deodorant support pedestal is removably positioned within the interior of the canister and it has a disc-shaped platform that is spaced a predetermined distance upwardly from the bottom of the canister for supporting a disc-shaped cake of deodorant/disinfectant.

A second alternative embodiment of applicant's novel canister has been designed for use with cakes of deodorant/disinfectant material and it may be formed from three components similar to the structure of the first alternative embodiment. Instead of having a deodorant support pedestal, this version has a measuring bucket that is removably inserted into the interior of the canister. The measuring bucket has a handle pivotally attached to its upper end. The width of the bucket is slightly less than the internal diameter of the canister and the combined height of the measuring bucket and the handle in its vertical position is less than the interior height of the canister. When it is time to add additional deodorant/disinfectant to the canister, the lid is removed and normally the level of the water in the canister is close to the top edge thereof. By lifting the handle of the bucket upwardly, not only is the bucket removed but also an amount equal to the volume of the interior of the bucket is also removed. This is important, if that particular amount of water were not removed, any attempts to add a cake of deodorant/disinfectant material into the canister would cause the water level to overflow. The measuring bucket has convenient external markings on it to indicate the amount of deodorant-/disinfectant powder that is inserted into the bucket.

DESCRIPTION OF THE DRAWING

FIG. 5 is a front elevational view of an alternative embodiment of applicant's novel canister;

FIG. 6 is a top plan view of the alternative embodiment of the canister;

FIG. 7 is a vertical cross sectional view of applicant's alternative embodiment of his novel canister;

FIG. 8 is a front perspective view of the deodorant support pedestal used in the alternative embodiment of applicant's novel canister;

FIG. 9 is an exploded cross sectional view illustrating the deodorant support pedestal seen in FIG. 8;

DESCRIPTION OF THE PREFERRED EMBODIMENT

Figure 2:
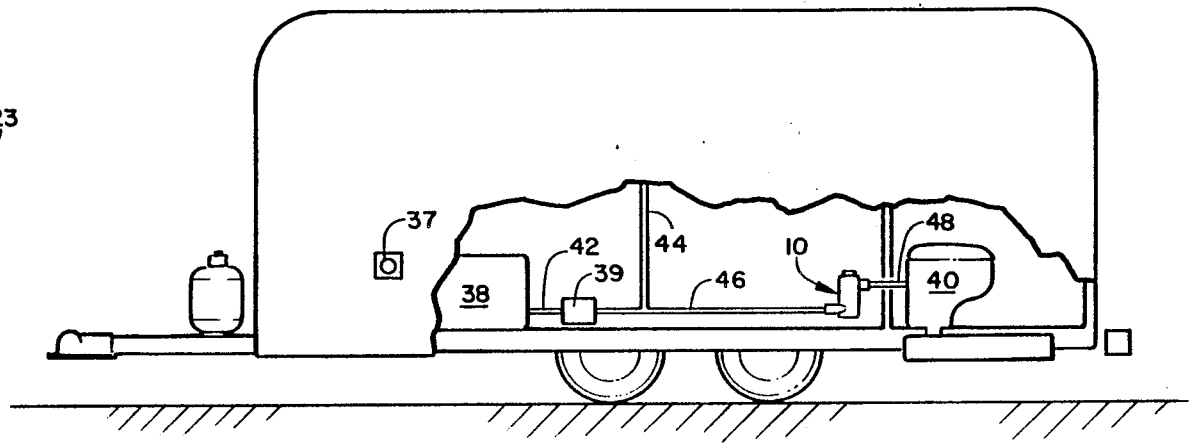
FIG. 2 is a schematic elevation view of a trailer with portions broken away illustrating the position where the canister is installed into the toilet system.
Figure 3:
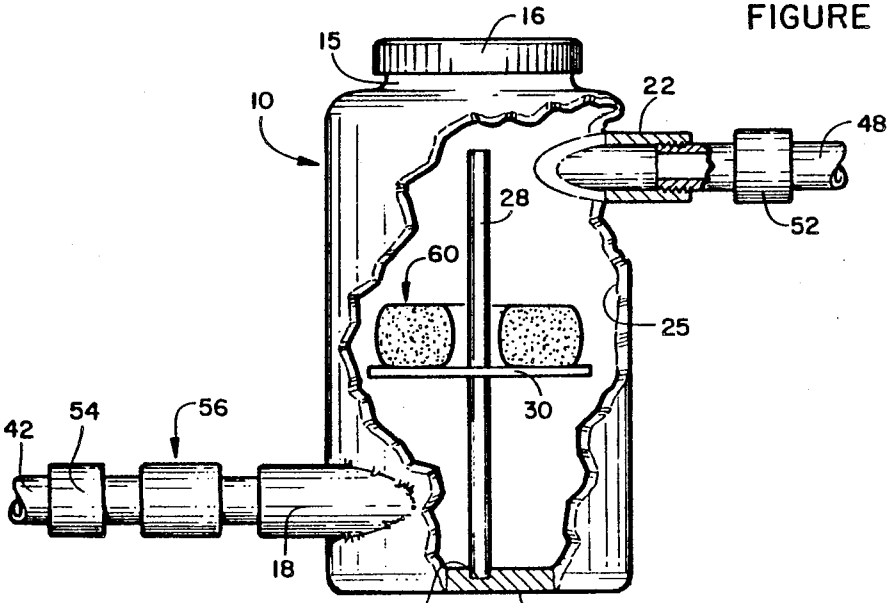
FIG. 3 is a side elevation view of the novel canister with portions broken away to disclose the interior thereof and also showing the manner in which it is connected to the toilet system of a trailer.
Figure 1:
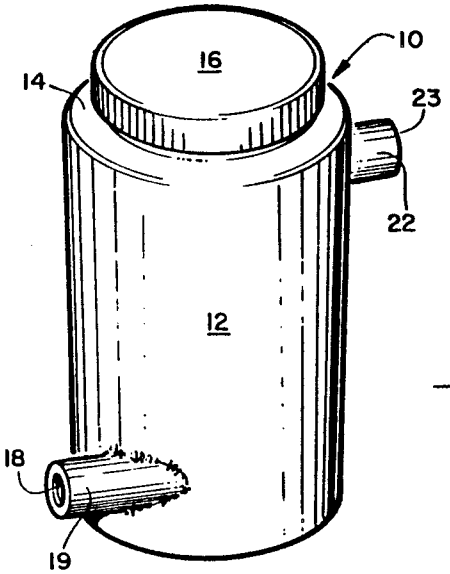
FIG. 1 is a front perspective view of applicant's novel canister for donut-shaped cakes of deodorant/disinfectant material.

Applicant's novel canister for donut-shaped cakes of deodorant/disinfectant material will now be described by referring to FIGS. 1–4 of the drawing. The canister is generally designated numeral 10. It has a cylindrical body 12 having a bottom wall 13, a top shoulder 14, a neck 15, and a removable lid 16.

A tubular boss member 19 has an inlet port 18 and it is welded to the outer surface of cylindrical body 12 adjacent its bottom end. Tubular boss member 22 has an outlet port 23 and it is welded to the cylindrical body 12 adjacent its top end. Both tubular boss members 18 and 22 have a tangential orientation to cylindrical body 12.

A chamber is formed in the interior of cylindrical body 12 by bottom wall 13, side walls 25 and top lid 16. A recess 27 is formed in bottom wall 13 and it receives the bottom end of rod 28. A disc-shaped platform 30 is mounted on rod 28 a predetermined height above the bottom wall 13.

In FIG. 2, a trailer 36 is illustrated having a fill cap 37, a water tank 38, a pump 39, canister 10 and toilet 40. Different lengths of tubing 42, 44, 46, and 48 connect the respective components. Coupling 52 connects outlet port 23 and tubing 48. Coupling 54 connects tubing 42 and one-way valve 56 which in turn is connected to inlet port 19.

Figure 4:
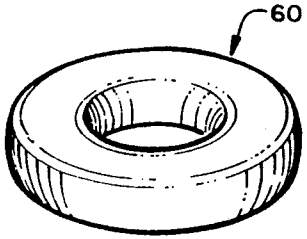
FIG. 4 is a perspective view of a donut-shaped cake of deodorant/disinfectant.
Figure 11:
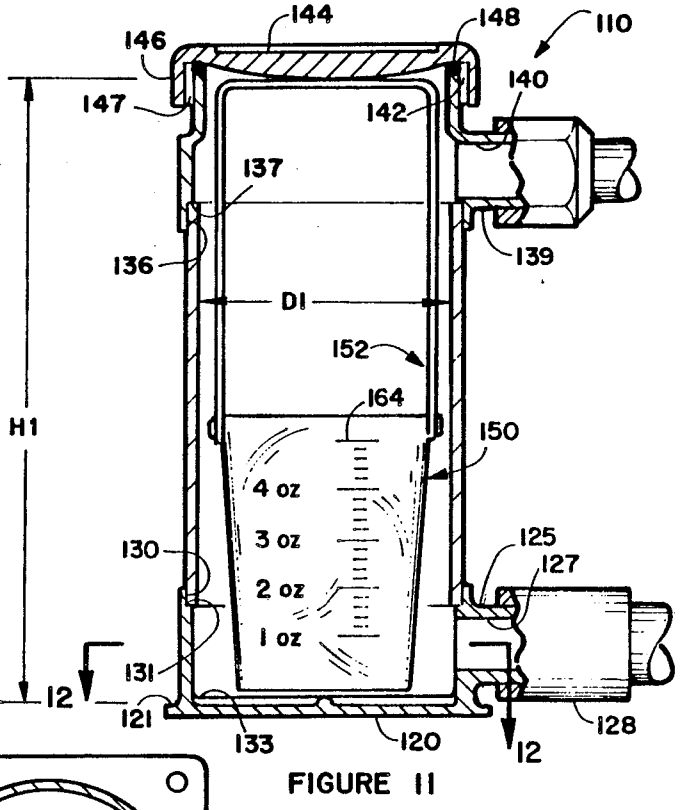
FIG. 11 is a vertical cross-sectional view of applicant's second alternative embodiment of his novel canister.
Figure 12:
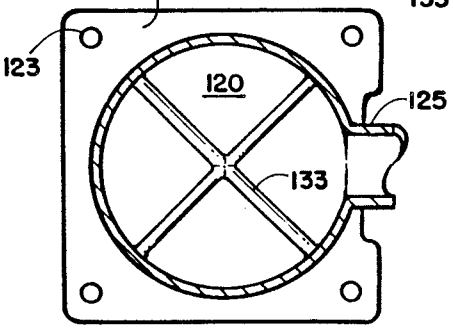
FIG. 12 is a top plan view of the cylindrical base member of the second alternative embodiment.
Figure 13:
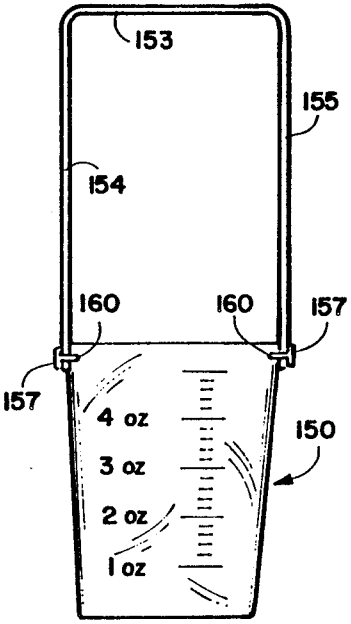
FIG. 13 is a side elevational view of the measuring bucket removed from the second alternative embodiment of applicant's novel canister.
Figure 14:
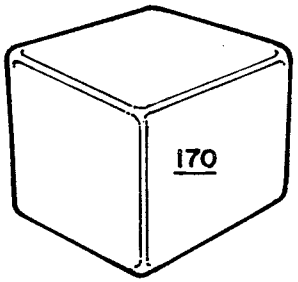
FIG. 14 is a perspective view of a cube shaped cake of deodorant/disinfectant.
Figure 10:
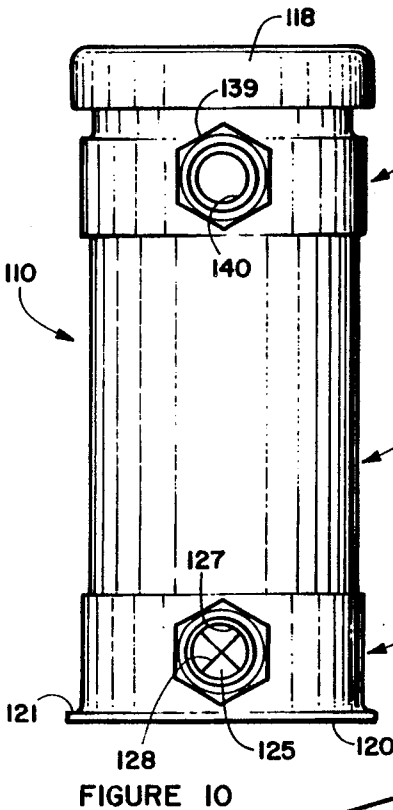
FIG. 10 is a front elevational view of a second alternative embodiment of the canister.

A donut-shaped cake 60 of deodorant/disinfectant chemical material is illustrated in FIG. 4.

An alternative version of applicant's novel canister for cakes of deodorant/disinfectant material will now be described by referring to FIGS. 5–9 of the drawings. A canister is generally designated numeral 70 and it is formed from cylindrical base member 72, cylindrical body member 74, cylindrical upper body member 76 and lid 78. Cylindrical base member 72 has a lower tubular boss member 80 having an input port 81 extending radially outwardly from its outer surface. A flange 82 extends horizontally outwardly from the bottom end of cylindrical base member 72. An annular relief portion 83 is formed adjacent the top edge of cylindrical base member 72 forming a shoulder 84 for telescopically receiving the bottom end of cylindrical body member 74.

Cylindrical upper body member 76 has a radially extending tubular boss member 86 having an outlet port 87. An annular relief portion 88 forms a shoulder 89 that mating receives the top end of cylindrical body member 74.

Lid 78 has a downwardly extending annular flange 90 that is internally threaded to mate with external threads on the top end of cylindrical upper body member 76. Finger gripping ribs 91 are spaced around the circumference of lid 78.

Deodorant support pedestal 93 is illustrated in FIGS. 8 and 9. It has a base 94 having an upwardly extending boss 95. A tubular post 96 telescopically mates with boss 95 and a boss 97 that extends downwardly from disc-shaped platform 98. An annular upstanding lip 99 functions to positively position disc-shaped cake 100 of deodorant/disinfectant.

A second alternative version of applicant's novel canister that would use a cake of deodorant/disinfectant material will now be described by referring to FIGS. 10–13 of the drawings. A canister is generally designated numeral 110. It is formed from cylindrical base member 112, cylindrical body member 114, cylindrical upper body member 116, and lid 118.

Cylindrical base member 112 has a bottom wall 120 having an outwardly extending flange 121 whose outer configuration is substantially square. A plurality of apertures 123 are formed therein for receiving screws for fastening the canister to a support structure. A tubular boss member 125 has an inlet port 127 with a one-way ball check valve 128 mounted therein. An annular recess 130 is formed adjacent the top inside edge of cylindrical base member 112 and it forms a shoulder 131 for supporting cylindrical body member 114 that is matingly received therein. Reinforcing ribs 133 are formed in the top surface of bottom wall 120.

Cylindrical upper body member 116 has an annular recess 136 formed adjacent its bottom edge on its interior surface and this also forms a shoulder 137. A tubular boss member 139 has an outlet port 140. The top edge of cylindrical upper body member 116 has external threads 142.

Lid 118 has a top wall 144 whose bottom surface has a convex curved configuration. An annular flange 146 extends downwardly and it has internal threads 147. An O-ring 148 is mounted in the interior of lid 118.

The internal diameter of cylindrical body member 114 is D1 and the internal height of the canister is H1. A measuring bucket 150 is removably mounted in the interior of canister of 114. It has an inverted U-shaped handle 152 having a crossmember portion 153, and laterally spaced downwardly extending leg portions 154 and 155. Fastener pins 157 pivotally secure the bottom ends of the U-shaped handle 152 to measuring bucket 150. They pass through aligned apertures in the measuring bucket and the leg portions and the shank portion 160 of the fastening pins pass therethrough. Raised marking lines 164 are formed on the outer surface of measuring bucket 150. A cake of deodorant/disinfectant 170 is deposited in measuring bucket 150.

What is claimed is:

1. In a recreational vehicle or the like having a water tank, a pump, a toilet and water line tubes connecting the same together in series, wherein the improvement comprises:

a canister for a cake of deodorant/disinfectant material in said water line tube between said pump and said toilet;

said canster being formed from a cylindrical base member, a vertically oriented cylindrical body member, a cylindrical upper body member and a removable lid;

said cylindrical base member has a tubular boss extending laterally therefrom having an inlet port with a one-way valve mounted therein, said cylindrical base member has a bottom wall having an outwardly extending flange whose outer configuration is substantially square, a plurality of apertures are formed in said flange for receiving screws for fastening said canister to a support structure;

said cylindrical upper body member has a tubular boss extending laterally therefrom having an outlet port;

said removable lid having a horizontal top wall and means for removably securing said lid to the top end of said cylindrical upper body member;

said canister having a predetermined internal height H1 and a predetermined internal diameter D1; and a measuring bucket having an outer diameter less than D1 removably inserted into the interior of said canister, an inverted U-shaped handle having downwardly extending leg portions that are secured to said measuring bucket and when the handle is extending upwardly the combined height of said measuring bucket and handle is less than H1.

2. The structure as recited in claim 1 further comprising means on the side walls of said bucket to measure the amount of deodorant/disinfectant material contained in said bucket.

3. The structure as recited in claim 1 wherein said inlet port and said outlet port are on the same side of said canister.

4. The structure as recited in claim 1 wherein said bucket has solid nonporous side and bottom walls.

5. The structure as recited in claim 1 wherein said handle is pivotally attached to the upper end of said bucket.

* * * * *